US007841141B2

(12) United States Patent
Nordli

(10) Patent No.: US 7,841,141 B2
(45) Date of Patent: Nov. 30, 2010

(54) COGGING PIECE

(75) Inventor: Bjarne Nordli, Aalesund (NO)

(73) Assignee: Isolaft AS C/O Spilka Industri AS, Aalesund (NO)

( * ) Notice: Subject to any disclaimer, the term of this patent is extended or adjusted under 35 U.S.C. 154(b) by 331 days.

(21) Appl. No.: 10/598,406

(22) PCT Filed: Mar. 18, 2005

(86) PCT No.: PCT/NO2005/000099

§ 371 (c)(1),
(2), (4) Date: Feb. 6, 2007

(87) PCT Pub. No.: WO2005/093183

PCT Pub. Date: Oct. 6, 2005

(65) Prior Publication Data

US 2007/0175129 A1 Aug. 2, 2007

(30) Foreign Application Priority Data

Mar. 26, 2004 (NO) ..... 20041280

(51) Int. Cl.
*E04B 1/10* (2006.01)

(52) U.S. Cl. ..... 52/233; 52/562; 52/568; 446/106; 403/409.1

(58) Field of Classification Search ..... 52/233, 52/562, 568, 570, 586.2, 585.1, 592.6, 590.2, 52/590.3, 590.1; 446/106, 108; 403/230, 403/381, 409.1
See application file for complete search history.

(56) References Cited

U.S. PATENT DOCUMENTS

| | | | | | |
|---|---|---|---|---|---|
| 2,016,382 | A * | 10/1935 | McBurney | 52/570 |
| 4,619,089 | A * | 10/1986 | Stein | 52/233 |
| 4,967,526 | A * | 11/1990 | Yost | 52/233 |
| 5,010,701 | A * | 4/1991 | Halsey et al. | 52/233 |
| 5,020,289 | A * | 6/1991 | Wrightman | 52/233 |
| 5,244,300 | A * | 9/1993 | Perreira et al. | 403/381 |
| 5,282,343 | A * | 2/1994 | Stein | 52/233 |
| 5,799,452 | A * | 9/1998 | Moore | 52/233 |
| 6,199,332 | B1 * | 3/2001 | Ellson | 52/233 |
| 6,837,016 | B2 * | 1/2005 | Simmons et al. | 52/655.1 |
| 2003/0024187 | A1 * | 2/2003 | Wilt | 52/233 |
| 2003/0136065 | A1 * | 7/2003 | Gjems | 52/233 |
| 2007/0204538 | A1 * | 9/2007 | Miller et al. | 52/233 |

* cited by examiner

*Primary Examiner*—Richard E Chilcot, Jr.
*Assistant Examiner*—William V Gilbert
(74) *Attorney, Agent, or Firm*—Dennison, Schultz & Macdonald

(57) ABSTRACT

Cogging piece (1) for use when notching log constructional elements (2) to other log constructional elements (2) or to corresponding separate log constructional elements (9). The cogging piece is adapted to be attached to both ends of each log constructional element (2) and to the end of each end constructional element (9) that is adapted to face a cogged joint. The cogging piece (1) is provided with lateral (4*at*, 4*bt*, 7*at*, 7*bt*) and axial (5*at*, 5*bt*, 6*at*, 6*bt*) inclined surfaces that are adapted to rest against corresponding axial and lateral surfaces respectively of cogging pieces attached to below and/or above intersecting log constructional elements and end constructional elements. Thus an increasing vertical force on a wall leads to an increased axial contraction of the cogged joints in the same wall.

10 Claims, 4 Drawing Sheets

COGGING PIECE

The present invention concerns constructions with cogged joints (notching) and more particularly building elements comprising log shaped constructional elements at one (wall) side of a cogged joint and an end constructional element at another (corner) side of a cogged joint, so that each cogged joint in principle is loose and needs to be fixed at the construction site. More particularly the present invention concerns a particular cogging end piece, hereinafter called cogging piece, which is prepared to be attached to both ends of each log shaped element and to the cogging end of each end constructional element, i.e. the end constituting part of the cogged joint when assembled.

BACKGROUND

It is an old tradition to make buildings with timber logs. In recent years this tradition has mainly been upheld with respect to building of cabins/leisure buildings. Cabins with cogged joints are generally seen to be particularly beautiful. Building with this tradition is, however, far from free of problems.

A disadvantage with notching of cabins/buildings in real timber is the high requirement of premium quality timber. Such timber is today a scarce resource and the buildings therefore become expensive. Another disadvantage is the specific thermal insulation. Compared to well insulated buildings of modern construction, the thermal insulation is significantly poorer. In a Nordic climate notched buildings that are not provided with an internal insulation are not suited for all year use and are quite uneconomical also for leisure use.

A third disadvantage relates to the fact that timber log buildings settle several per cent (cm per meter height) in the first years, which leads to severe problems with respect to maintaining tight doors, avoiding doors from becoming jammed and maintaining leakage free roof openings for chimneys and ventilation.

Against this background and recognizing a need for a more extensive use of recycled materials in building production in general, attempts have been made to create constructional elements that look like real timber but consist of an internal, insulated core and a wooden or wood-like housing or "shell".

Norwegian patent No. 311 583 describes timber like elements for notching where each side of the elements is comprised by several (e.g. 3) joined panel elements that are profiled in a manner so that their outer sides, subsequent to joining, appear as substantially continuous, convex surfaces. Between these joined panel elements spacer elements are arranged that serve to hold the panels in a steady, unchanged mutual distance from each other. The same spacer elements serve to give the entire building its required strength. The void between the outer parts is intended to be filled with a thermally insulating material, e.g. polyurethane. Near the ends the elements are provided with recesses for notching. The construction has the disadvantage that preparing and assembling of each timber-like element from individual panels and spacers is a comparatively complex process.

Swedish laid-open publication No. 457 456 describes a "timber-element" with outer tree panels provided with longitudinal groves, where spacers are arranged in the groves. The void between the panels and the spacers are, in this construction, also intended to be filled with a thermally insulating material like foamed polyurethane. Holes are arranged in certain positions in the spacers so that rods 8 may be positioned (vertically) through the holes in each element of a completed wall, whereby said rods may constitute the weight carrying elements of the wall. Like the construction discussed above, this construction comprises many components that need to be adapted to each other. It is thus quite a "puzzle" to put together one single timber element from its separate components.

U.S. Pat. No. 4,433,519 describes a hollow, cylindrical prefabricated constructional element intended for the same use as the above mentioned publication. Here it is assumed that the convex outer surfaces are made either by glass fibre, metal, plastic or moulded wooden products with the required structural integrity. The outer panels are thus not made in a natural wooden material. Flanges at the upper and lower side of the constructional elements are arranged to overlap when the elements are placed on top of each other, and they are provided with holes so that bolts or the like may be inserted through the elements to lock the elements together. Like the previously discussed constructions this one also comprises spacer elements that are arranged at certain intervals along the elements, but here the prefabricated elements themselves are designed to carry most of the weight load. The void between the elements is preferably filled with a thermally insulating material. This construction has the advantage over the previous ones that it is assembled from fewer components but on the other hand the side panels are not made entirely in wood.

Swedish laid-open publication No. 440 250 describes still another product intended for notching, and it constitutes outer wooden panels with inner spacers that are attached to the side panels by means of longitudinal grooves in the latter. A wooden panel according to this publication does not comprise a convex outer surface. It is mentioned, however, that the edges may be chamfered to give a visual impression of such a convex surface.

In Norwegian patent application No. 2002 6234 there is described a constructional element intended for notched assembly in which the inside of curved panels in real wood is furnished with ribs to hold the panels with a stable curvature over time and to provide the panels with strength in their vertical direction, so that assembled buildings will not settle. The constructional element according to this patent application, which is easily mass produced, also comprises a diffusion proof coating.

All said solutions for notching of constructional elements that are not real timber, have cogged joints that are loose in the sense that any constructional element (log) that lies between two cogged joints is manufactured separately from the building elements lying at the opposite side (outside) of same cogged joints. For instance, when making a building in accordance with said Norwegian patent application 2002 6234, there is used an end constructional element to terminate each log element, preferably an end constructional element in real timber and with a profiled opening facing the cogged joint, said profile being adapted to be assembled with a log constructional element opposite the cogged joint by means of a so-called cogging element that accurately fits into the profiled opening in the end constructional element and into a corresponding profiled opening in the end of the log constructional element.

Use of loose cogged joints implies that the joints during notching need to be secured or "locked" so that they do not unintentionally slide out over time. There are many ways to do this and the most important aspect is that the manufacturing process is simple and adapted for mass production and that the assembly is simple and efficient so that the assembly of the buildings is correspondingly efficient.

Objects

It is thus an object of the present invention to provide a system for interlocking a log constructional element with an end constructional element or with another log constructional element when notching with "loose" cogged joints. The system should be one where the components are easily manufactured and assembled and ensure that the assembly of buildings with such constructional elements is not unnecessarily time consuming at the construction site.

It is a further object of the invention that the system should not comprise components that are visible subsequent to the assembly.

The Invention

For the sake of understanding it should be mentioned that when axial and lateral projections with inclined planes are discussed in the following, the axial projections have laterally inclined planes while the lateral projections have axially inclined planes.

When the present invention is practiced normally the cogging pieces according to the invention are permanently fixed to the log constructional elements and to the end constructional elements during their fabrication, so they will not be present as loose cogging pieces at the construction site. It should be emphasized that as used herein, a cogging piece and an end constructional element are quite different constructional elements. An end constructional element typically has the shape of a log end and is visible outside a cogged joint while the cogging pieces are elements normally manufactured in a synthetic material that subsequent to assembly are positioned in the cogged joints to not be visible and are permanently attached to the ends of end constructional elements and log constructional elements.

The cogging pieces are typically manufactured in an inexpensive synthetic material with an appropriate durability. The cogging pieces will, subsequent to assembly of a building, not be exposed to sunlight and therefore need not be provided with extra protection against UV-initiated degradation.

When cogging pieces according to the invention are attached to log constructional elements comprising an outer board or panel with an inner plastic barrier layer, it is convenient that the cogging pieces are welded or otherwise attached to the plastic barrier layer in a manner so that a continuous diffusion proof barrier is provided against the internal volume of each log constructional element.

During notching of a log constructional element to an end constructional element, both provided with cogging pieces according to the present invention, there will normally be used stiffening members as described in Norwegian patent application 2002 6234 that after assembly are hidden inside the cogged joints. The stiffening members have an outer profile that closely fits into the profile of axial recesses in both end constructional elements and log constructional elements. It should, however, be noted that neither the log constructional element, the end constructional element nor the stiffening member constitute parts of the present invention, as these may be of the same kind as described in NO 2002 6234.

In the following the invention will be described in further detail with reference to the accompanying drawings.

FIG. 1*a* is a perspective view of a log constructional element with a mounted cogging piece according to the present invention, FIG. 1*b* is a perspective view of the same building element as FIG. 1 but seen from a different angle.

Figure 1A:
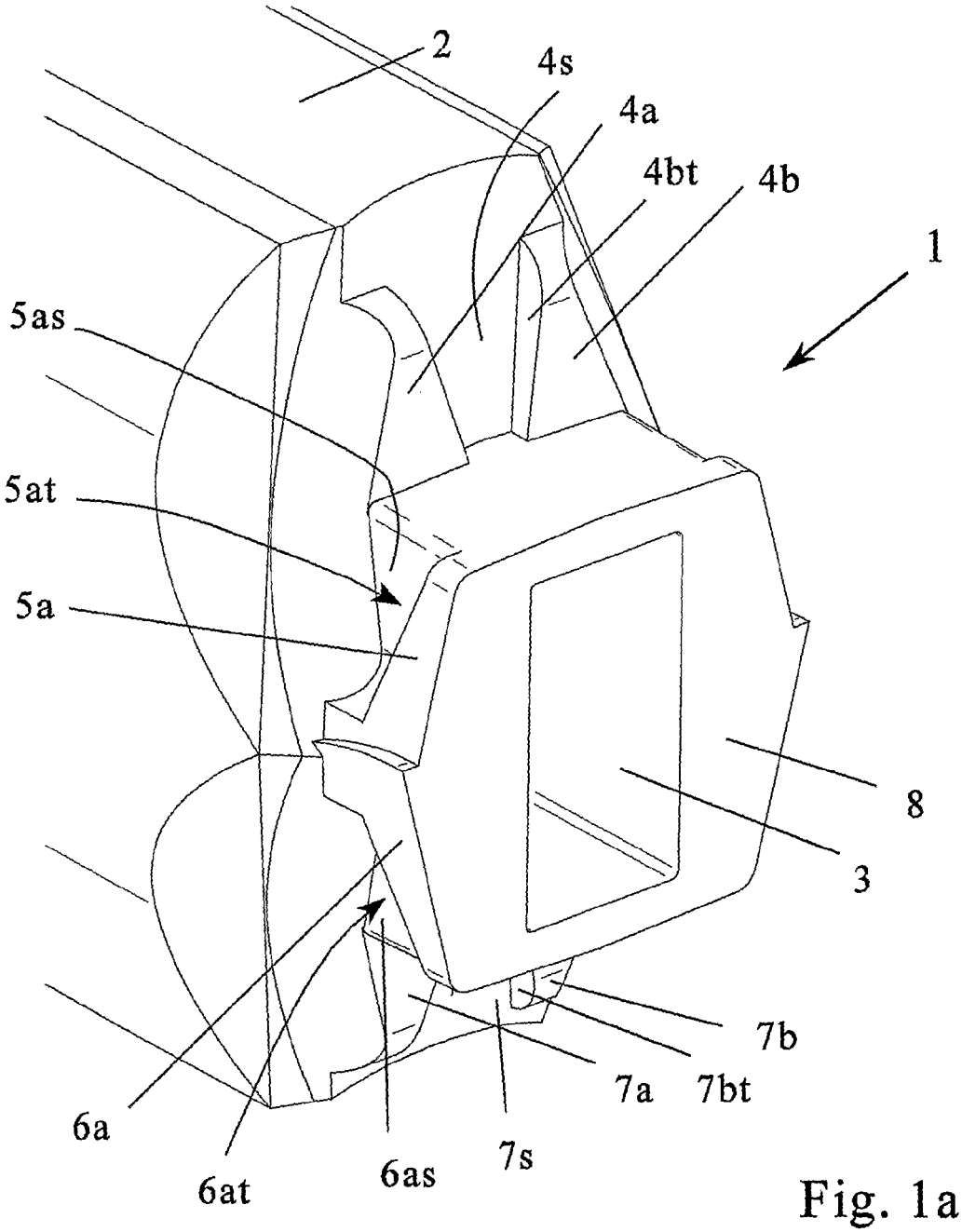
Figure 1B:
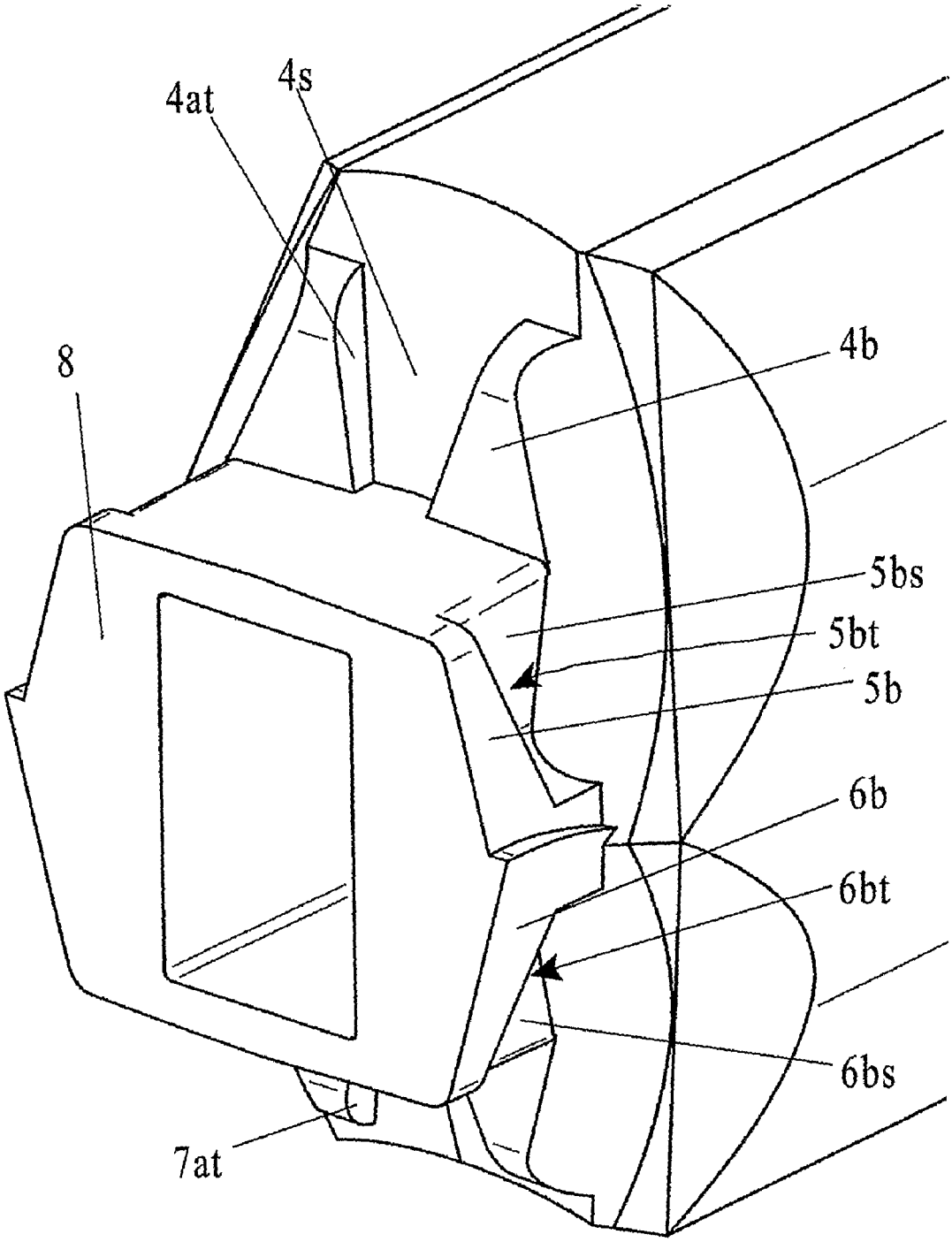
Figure 2:
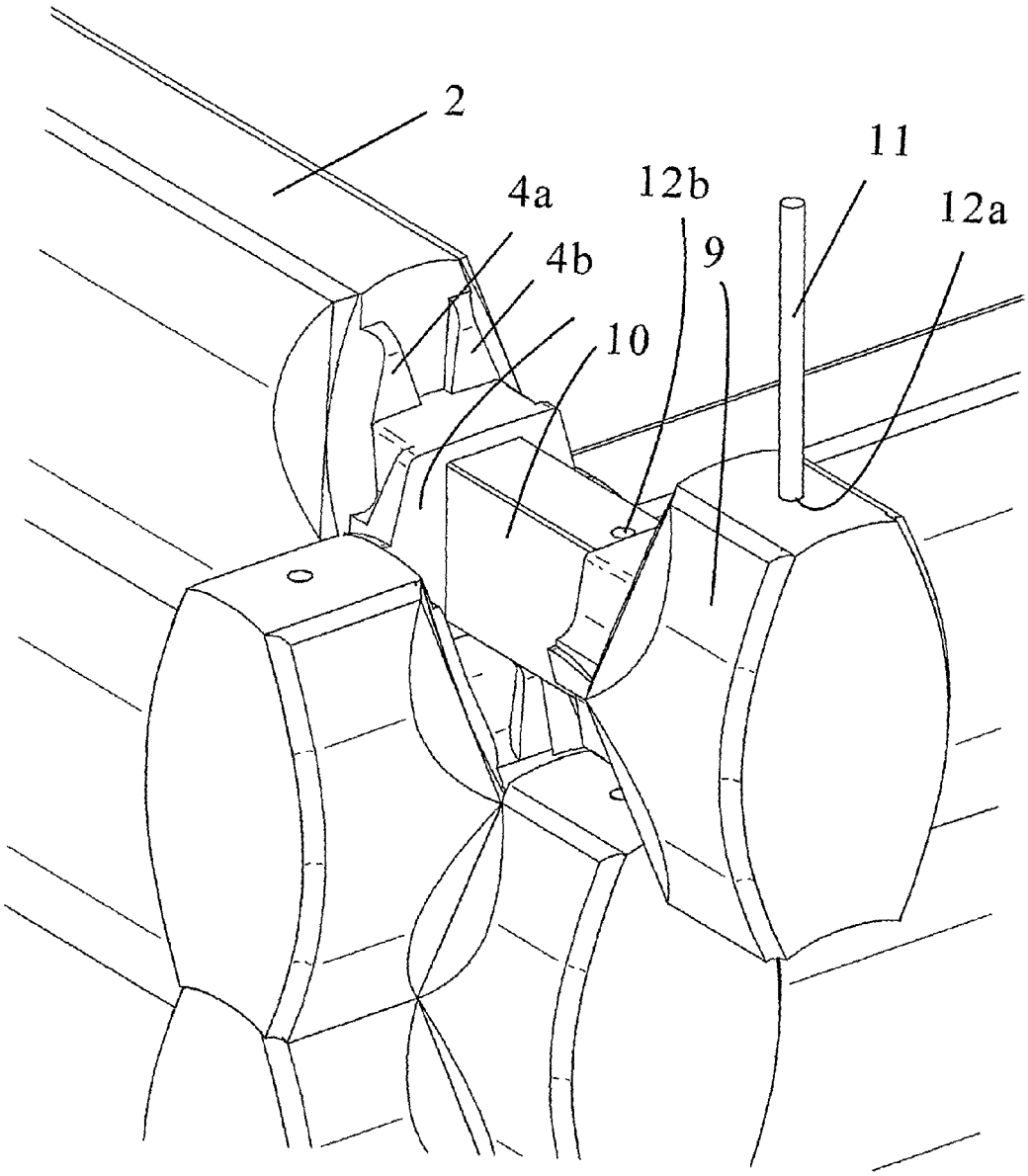
FIG. 2 is a perspective view of a corner of a building during assembly, with cogging pieces according to a variant of the present invention attached to log and end constructional elements.

FIG. 1 a shows a cogging piece 1 mounted to the end of a log constructional element 2 that generally may be of the kind described in Norwegian patent application No. 2002 6234 or another type of log constructional element for notching. The cogging piece 1 has a central, axial aperture 3 with a profile corresponding to the profile of a cogging element 10 (FIG. 2). When in the following the terms lateral and axial are used, it should be understood that these terms are solely in relation to the axis of the log or end constructional element to which the cogging piece in question is attached. FIG. 1*b* shows in principle the same as FIG. 1*a*, but from a different perspective so that some surfaces that are hidden in FIG. 1*a* are visible in FIG. 1*b* and vice versa.

The cogging piece 1 shown in FIGS. 1*a* and 1*b* has two upper, axial projections 4*a*, 4*b*. The inner, lateral surfaces of these projections are plane inclined surfaces 4*at*, 4*bt* that together define a downward tapered wedge-shaped region 4*s* between the projections 4*a* and 4*b*. It is to be understood, though not easily seen in FIGS. 1*a* and 1*b*, that the cogging piece has similar lower, axial projections 7*a*, 7*b* with corresponding inclined, plane surfaces 7*at* and 7*bt* that together define an upward tapered wedge-shaped region 7*s*. It is preferred that the projections 7*a*, 7*b* have the same shape and size as the projections 4*a* and 4*b* and are symmetrical with these about a horizontal plane through the middle of cogging piece 1. Thus the upward tapered, wedge-shaped region 7*s* will have same size and dimension as the downward tapered, wedge-shaped region 4*s*.

Furthermore the cogging piece 1 has upper lateral projections 5*a*, 5*b* that are symmetrical with one another and face outwards on each respective side in relation to the axis of the log constructional element 2 and are tapered upwards with inclined surfaces 5*at* and 5*bt* respectively each of which faces the log constructional element 2. The outermost end or side of the projections 5*a* and 5*b* lie in a plane end surface 8 of the cogging piece. Between the end of the log constructional element 2 to which the cogging piece 1 is attached and the inclined surfaces 5*at* and 5*bt* there are defined downward tapered, wedge-shaped regions 5*as* and 5*bs* respectively. These have dimension and shape adapted to the dimension and shape of the lower axial projections 7*a* and 7*b*, that preferably are identical with but oppositely directed in relation to the upper axial projections 4*a* and 4*b*.

In addition the cogging piece 1 has lower lateral projections 6*a*, 6*b* that are symmetrical and face outwards on each respective side in relation to the axis of the log constructional element 2 and are tapered downwards with inclined surfaces 6*at* and 6*bt* respectively that each faces the log constructional element 2. The outermost end or side of the projections 6*a* and 6*b* lie in a plane end surface 8 of the cogging piece. Between the end of the log constructional element 2 to which the cogging piece 1 is attached and the inclined surfaces 6*at* and 6*bt* there are defined upward tapered, wedge-shaped regions 6*as* and 6*bs* respectively. These have dimension and shape adapted to the dimension and shape of the upper axial projections 4*a* and 4*b*.

During notching, see also FIG. 2, a cogging piece 1 as shown in FIGS. 1*a* and 1*b* is positioned closely adjacent to another, oppositely directed cogging piece that is attached to another log constructional element or to an end constructional element so that the plane end surfaces 8 of the oppositely directed cogging pieces rest tightly against each other.

The dimensions of the projections 5*a* and 5*b* are such that when two oppositely directed cogging pieces 1 rest against each other with the plane surfaces 8 in tight mutual contact, a projection 5*a* on a first cogging piece and the laterally reversed projection 5*b* of the second cogging piece together form an upward tapered, wedge-like projection with a dimension and shape that is adapted to the upward tapered wedge-like region 7*s* between the lower axial projections 7*a*, 7*b* .

From what is described above it will be understood that the wedge-like region 7*s* of one cogging piece, independent on whether the cogging piece is attached to a log constructional element or to an end constructional element, will force the projections 5*a* and 5*b* on one side of the cogged joint in the pair of oppositely directed cogging pieces attached to the closest below intersecting log and end constructional elements, alternatively the closest below intersecting log and log constructional elements. In this manner the surfaces 8 of two cogging pieces resting against each other, will be forced against one another.

In a corresponding manner the projection 5*b* of the first cogging piece and the projection 5*a* of the second (adjacent) cogging piece together will form an upward tapered wedge-like projection with shape and dimension adapted to the upward tapered, wedge-like region between the lower axial projections 7*a*, 7*b*.

Furthermore, and correspondingly, lateral projection 6*a* of the first of two adjacent, oppositely directed cogging pieces 1 and the laterally reversed lower lateral projection 6*b* of the second cogging piece together form a downward tapered, wedge-like projection with a shape and dimension that is adapted to the downward tapered, wedge-like region 4*s* between the upper axial projections 4*a*, 4*b*.

All cogging pieces 1 that are attached to a log constructional element 2 or to an end constructional element 9 in a notched building will lie adjacent to and oppositely directed in relation to a corresponding cogging piece 1 attached to a log constructional element 2 or an end constructional element 9 on the opposite side of the same cogged joint. Furthermore, in the illustrated embodiment, any axial upper projection 4*a* or 4*b* will be positioned in a region 6*as* or 6*bs* in the closest above intersecting pair of oppositely oriented cogging pieces 1, while the projections 4*a* and 4*b* together enclose a pair of adjacent lateral projections 6*a*/6*b* in the closest above intersecting pair of oppositely oriented cogging pieces. Correspondingly any axial lower projection 7*a* or 7*b* will be positioned in a region 5*as* or 5*bs* in the closest below intersecting pair of oppositely oriented cogging pieces 1, while the projections 7*a* and 7*b* together enclose a pair of adjacent lateral projections 5*a*/5*b* in the closest below intersecting pair of oppositely oriented cogging pieces.

More generally any upper axial projection of a cogging piece will have an inclined surface that communicates with an inclined surface of a lower lateral projection of a second cogging piece intersecting immediately above the first one. Correspondingly any lower axial projection of a cogging piece will have an inclined surface that communicates with an inclined surface of an upper lateral projection of a second cogging piece intersecting immediately below the first one. Furthermore any pair of upper axial projections on one and the same cogging piece will envelop and force together two adjacent lateral lower projections on two different, oppositely oriented cogging pieces intersecting immediately above the first one. Correspondingly any pair of lower axial projections on one and the same cogging piece will envelop and force together two adjacent lateral upper projections on two different, oppositely oriented cogging pieces intersecting immediately below the first one.

The skilled artisan will understand that it is not necessary and not even convenient, that the wedge-like projections 4 and 7 completely fill the corresponding wedge-like regions 6*as*/6*bs* and 5*as*/5*bs* respectively. It is preferred that the height of the wedge-like projections 4 and 7 is somewhat less than the height of the wedge-like regions 5*as*, 5*bs*, 6*as*, 6*bs* to ensure that the projections 4 or 7 can not touch bottom of said regions. It is thereby ensured that the inclined surfaces at all times carry all forces put on the cogged joints by the weight of the above log constructional elements and end constructional elements. The larger the force applied to the inclined surfaces of the described projections is, the tighter the cogged joints are held together.

The forces naturally are higher the more weight or force that is put on. The lowermost cogged joints in a building will be held together by a force determined by the weight of the entire wall above plus any weight put on the wall from the roof above, while the uppermost cogged joints are held together only by the weight of the roof. If it is deemed necessary the uppermost cogged joints may be secured by means of bolts or the like. If log constructional elements according to Norwegian patent application No. 2002 6234 are used, where bolts extend all the way from the uppermost log constructional element to the foundation wall to ensure that the wall is held in place, the force inflicted by the bolts comes in addition to the weight from the wall and from the roof.

FIG. 2 shows a corner of a building notched according to the present invention, with a particularly designed cogging piece 1' attached to each end constructional element 9. The cogging piece 1' lacks the lateral projections 5*a*, 5*b*, 6*a*, 6*b*. Thus the end constructional element 9 may be axially withdrawn from the cogged joint unless otherwise fastened. FIG. 2 shows a releasable attachment mechanism for the end constructional element 9 which includes a locking pin 11 arranged to be positioned in a bore 12*a* in the end constructional element 9 and a corresponding hole 12*b* in the stiffening member 10. The stiffening member 10 in turn will normally be rigidly attached to the log constructional element 2 or to the cogging piece that is attached to said log constructional element. The purpose of utilizing such modified cogging pieces 1' on the end constructional elements is the ability to thereby replace end constructional elements with log constructional elements if it is desired to extend the building with some new rooms.

Figure 3:
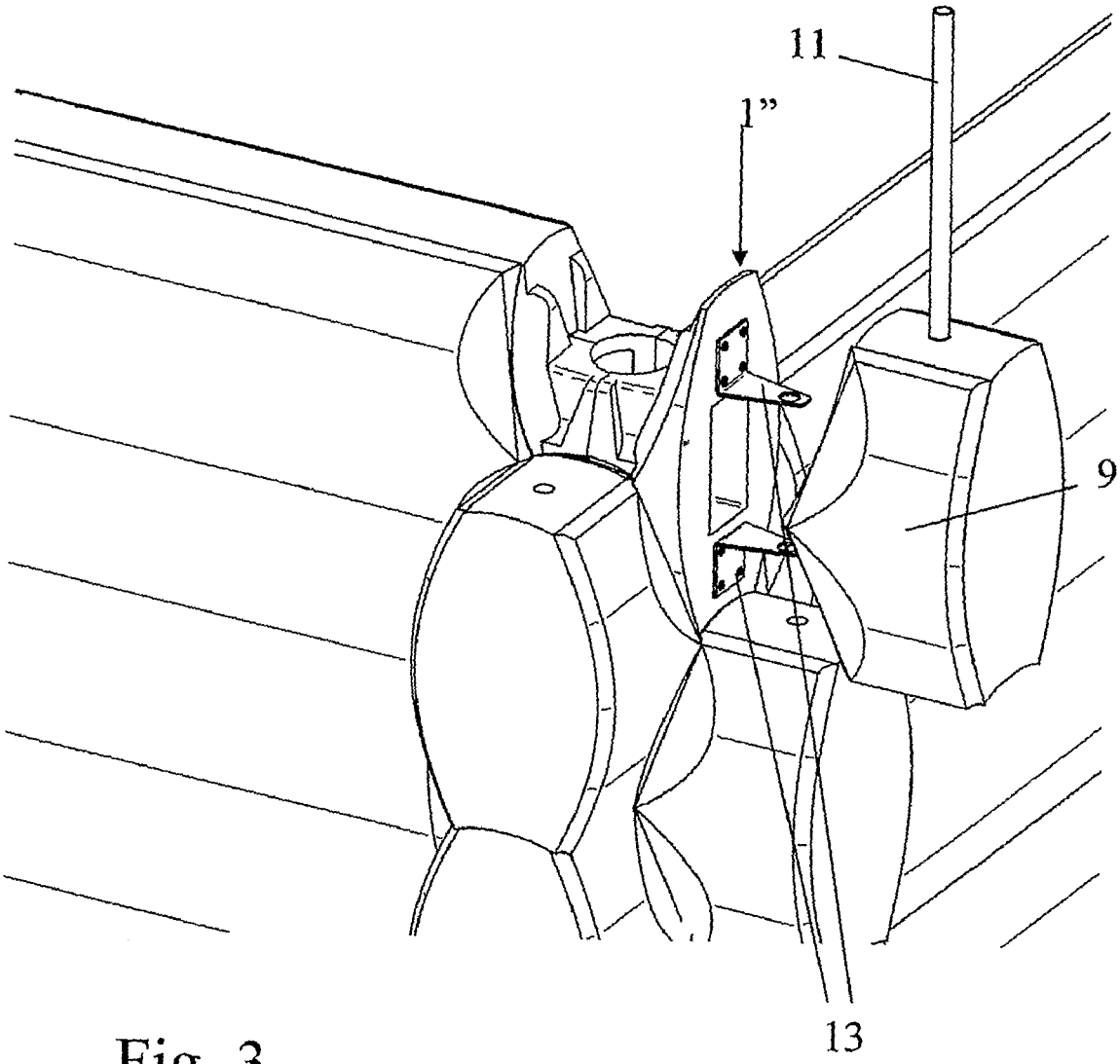
FIG. 3 is a perspective view of a corner of a building during assembly that is notched with use of cogging pieces according to a variant of the present invention different to that shown in FIG. 2.

FIG. 3 shows, compared to FIG. 2, a different variant of a cogging piece 1" that is designed to make an end constructional element attached thereto releasable from a cogged joint for replacement by a log constructional element 2. Contrary to the embodiment shown in FIG. 2 the cogging piece 1" remains in place in the cogged joint during replacement of the end constructional element with a log constructional element, since the cogging piece 1" is provided with brackets 13 at its backside, adapted, when required, to be released from the end constructional element 9 (or log constructional element 2). As illustrated by FIG. 3, there is a similarity with the embodiment of FIG. 2 in that a locking pin 11 in assembled condition locks the end constructional element to the cogging piece. The brackets 13 are provide with holes that are sufficiently large to receive the locking pin 11. No stiffening members are shown in FIG. 3, but such members may also be used also with this variant of the invention and will be provided with through holes as shown in FIG. 2. It is furthermore possible to attach the end constructional elements temporarily to the particular cogging pieces 1' or 1" with locking pins that are inserted horizontally or inclined instead of vertically. It is, however, more difficult to do this in a manner that is invisible when completed.

The stiffening member 10 will normally be manufactured in a synthetic material (plastic) but may also be made of wood, composite materials or metal. At an outer corner of a building where a log constructional element 2 is joined with an end constructional element 9, the accompanying stiffening member 10 will typically be fixed to one of these elements with a screw or the like that may penetrate the relevant cogging piece for instance in the region 5*as* or 6*as* (or 5*bs* or 6*bs*) and penetrates the stiffening member 10 inside the aperture 3. It is thereby ensured that the stiffening member does not become displaced in relation to the cogged joint during assembly or afterwards. The screw must be countersinked or positioned in a recess to avoid interference with the axial projection 4 or 7 from the relevant intersecting cogging piece attached to building elements immediately below or above.

For particular purposes and to obtain a superior strength of the cogged joints, particularly designed stiffening members 10 may be utilized and in other materials, like fibre reinforced composite materials or metal. This may be relevant e.g. where an upper part of a building is extended compared to the building below and thus exhibits a considerable overhang. Thus a significant amount of forces must be carried by the outer not from below supported part of the first log constructional element in the extended part of the building. Such overhangs are quite common in the traditional Norwegian food storage houses on pillars (stabbur). In addition to use of different materials for the stiffening member it may also be relevant to use stiffening members of another length, as it would be sensible to use a stiffening member that is sufficiently long to reach within the cogged joint below (in the non extended part of the building) to be supported by same.

It should be emphasized that the precise shape of the different projections herein described is not important. What is important is that each cogging piece by means of said projections is provided with both axial and lateral surfaces and since each cogging piece in an assembled building has an orientation that is perpendicular to the closest cogging pieces above and below, the inclined surfaces on the lower, axial projections of any one cogging piece will rest against inclined surfaces on upper lateral projections on the closest cogging piece below and vice versa. The result is a constructional system that at the construction site is as easy to assemble as LEGO®. It should furthermore be understood that the cogging piece according to the present invention may very well be adapted to building systems for toys, though it is primarily intended for full scale buildings of cabins and houses.

In the foregoing the invention is directed to a per se separate cogging piece that preferably during manufacture is permanently attached to a log constructional element or to an end constructional element. It is, however, also possible to manufacture "cogging pieces" that extend over a significant length of a log constructional element/end constructional element. It is obvious that if the parts of the cogging piece that after notching are positioned inside a cogged joint have functionality as described above, they will be covered by the present invention independent of the axial extension, visible or hidden, parts of the cogging piece may have.

The cogging pieces will normally be made in a synthetic material that is comparatively rigid and maintains its shape under varying conditions but still has a certain flexibility. The log constructional element to which the cogging pieces are attached will normally be "dead" material that does not hold any tension that will tend to make them bend or twist during storage, independent of moisture and temperature variations. This contributes to easy and problem free assembly independent of time of year and weather conditions. Most preferred are cogging pieces that are manufactured by injection moulding of high density polyethylene.

With respect to the manufacture, but even more with respect to user friendliness, it is desirable that the cogging pieces have a high degree of symmetry. It is thus preferred that the upper, axial projections (4*a*, 4*b*) are mutually symmetrical about a vertical plane and that the lower axial projections (7*a*, 7*b*) are mutually symmetrical about the same vertical plane.

Furthermore it is preferred that the upper axial projections (4*a*, 4*b*) are symmetrical with the lower axial projections (7*a*, 7*b*) about a horizontal plane. It is also preferred that the upper lateral projections (5*a*, 5*b*) are mutually symmetrical about a vertical plane and that the lower lateral projections (6*a*, 6*b*) are mutually symmetrical about the same vertical plane.

In the drawings the cooperating surfaces 4*s*, 5*as*, 5*bs*, 6*as*, 6*bs* and 7*s* are all shown as side surfaces on projections. It is to be understood that some of the cooperating surfaces may also be provided in the form of recesses.

The invention claimed is:

1. In combination with two log constructional elements (2) (9) used in log wall construction, a cogging piece (1) for use in joining one of said log constructional elements to the other; the improvement comprising, said cogging piece having an end surface (8) and being adapted to be attached to an end of each log constructional element (2) (9) that faces a cogged joint, wherein the cogging piece (1) is provided with upper and lower lateral (4*at*, 4*bt*, 7*at*, 7*bt*) surfaces formed on respective upper and lower axial projections that extend from respective upper and lower laterally inclined surfaces, said axial projections configured to abut an end surface of one of the log constructional elements in the installed position, said upper and lower axial (5*at*, 5*bt*, 6*at*, 6*bt*) inclined surfaces extending between said axial projections, said lateral and axial surfaces taken in relation to the length axis of the log constructional elements, said cogging piece having an inclined projection extending laterally on each side of said end surface of the cogging piece, and which cogging piece is adapted to rest against corresponding axial and lateral surfaces respectively of a second cogging piece attached to an intersecting log constructional element, wherein increasing vertical force on the log wall results in an increased axial contraction of the cogged joints in the said wall.

2. The combination as set forth in claim 1, wherein each the cogging piece is provided with two upper axial projections (4*a*, 4*b*) on which are formed said upper laterally inclined surfaces (4*at*, 4*bt*) and two lower axial projections (7*a*, 7*b*) on which are formed said lower laterally inclined surfaces (7*a*t, 7*b*t), two upper lateral projections (5*a*, 5*b*) on which are formed said upper axially inclined surfaces (5*at*, 5*bt*) and two lower lateral projections (6*a*, 6*b*) on which are formed said lower axially inclined surfaces (6*at*, 6*bt*).

3. The combination as set forth in claim 2, wherein the upper axial projections (4*a*, 4*b*) are mutually symmetrical about a vertical plane and the lower axial projections (7*a*, 7*b*) are mutually symmetrical about the same vertical plane.

4. The combination as set forth in claim 3, wherein the upper axial projections (4*a*, 4*b*) are symmetrical with the lower axial projections (7*a*, 7*b*) about a horizontal plane.

5. The combination as set forth in claim 2, wherein said upper lateral projections (5*a*, 5*b*) are mutually symmetrical about a vertical plane and the lower lateral projections (6*a*, 6*b*) are mutually symmetrical about the same vertical plane.

6. The combination as set forth in claim 2, wherein a substantially wedge-like region (7*s*) is defined between said upper laterally inclined surfaces (4*at*, 4*bt*), said region corresponding with the shape of said two lower lateral projections (6*a*, 6*b*), and wherein two cogging pieces positioned adjacent to each other will have their end surfaces (8) in contact with each other.

7. The combination as set forth in claim 2, wherein a substantially wedge-like region (7*s*) is defined between said lower laterally inclined surfaces (7*at*, 7*bt*), said region corresponding with the shape of said two upper lateral projections (5*a*, 5*b*), and wherein two cogging pieces positioned adjacent to each other will have their end surfaces (8) in contact with each other.

8. The combination as set forth in claim 1, wherein each cogging piece (1) includes means for permanently attaching the same to said log constructional element.

9. The combination as set forth in claim 1, wherein each cogging piece (1) includes means for temporarily attaching the same to a log constructional element (2).

10. The combination as set forth in claim 1, wherein the cogging piece (1) is arranged to be attached to said log constructional element (2) (9) by means of brackets (13) and a locking pin (11).

* * * * *